US009935388B2

(12) United States Patent
Tziviskos et al.

(10) Patent No.: US 9,935,388 B2
(45) Date of Patent: Apr. 3, 2018

(54) CONTACT-SUPPORT MECHANISM FOR INCREASED RETENTION FORCE

(71) Applicant: Apple Inc., Cupertino, CA (US)

(72) Inventors: George Tziviskos, Cupertino, CA (US); Paul J. Hack, San Jose, CA (US); Zheng Gao, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/617,957

(22) Filed: Feb. 10, 2015

(65) Prior Publication Data

US 2015/0214649 A1 Jul. 30, 2015

Related U.S. Application Data

(63) Continuation of application No. 13/913,277, filed on Jun. 7, 2013, now Pat. No. 8,951,071.
(Continued)

(51) Int. Cl.
*H01R 24/00* (2011.01)
*H01R 13/187* (2006.01)
(Continued)

(52) U.S. Cl.
CPC ..... *H01R 13/187* (2013.01); *H01R 13/15* (2013.01); *H01R 24/58* (2013.01); *H01R 43/00* (2013.01);
(Continued)

(58) Field of Classification Search
CPC ..... H01R 13/187; H01R 13/5202; H01R 12/716; H01R 2105/00; H01R 24/58;
(Continued)

(56) References Cited

U.S. PATENT DOCUMENTS 4,534,603 A * 8/1985 Brown ..... H01R 13/187 439/82
6,093,058 A 7/2000 Wu
(Continued)

OTHER PUBLICATIONS

Notice of Allowance dated Sep. 26, 2014 for U.S. Appl. No. 13/913,277, 8 pages.

*Primary Examiner* — Jean F Duverne
(74) *Attorney, Agent, or Firm* — Kilpatrick Townsend & Stockton, LLP

(57) ABSTRACT

Circuits, methods, and apparatus that may provide audio jacks capable of providing a sufficient retention force to avoid some inadvertent extractions of an audio plug. Examples may also provide audio jacks that may be readily assembled. Other examples may provide other types of connectors. These audio jacks or other connectors may provide contact structures having one or more contacts, each having a contact support to increase contact retention force. Different materials may be used to form the contacts and the contact supports. In this way, contacts may be formed using a highly conductive material, while the contact supports may be formed of a material having good spring characteristics. While such a contact may not be able to provide an adequate retention force on its own, the use of a contact support may sufficiently increase the retention force to prevent accidental extractions of an audio plug or other connector.

25 Claims, 10 Drawing Sheets

Related U.S. Application Data

(60) Provisional application No. 61/799,119, filed on Mar. 15, 2013.

(51) Int. Cl.

| | |
|---|---|
| ***H01R 24/58*** | (2011.01) |
| ***H01R 13/15*** | (2006.01) |
| ***H01R 43/00*** | (2006.01) |
| *H01R 13/703* | (2006.01) |
| *H01R 13/717* | (2006.01) |
| *H01R 107/00* | (2006.01) |

(52) U.S. Cl.
CPC ..... *H01R 13/7033* (2013.01); *H01R 13/7175* (2013.01); *H01R 2107/00* (2013.01); *Y10T 29/49208* (2015.01)

(58) Field of Classification Search
CPC .... H01R 13/7031; H01R 27/02; H01R 13/15; H01R 13/7175; H01R 13/7033; H01R 143/00; Y10S 439/91; Y10T 29/49208
USPC ..... 439/668
See application file for complete search history.

(56) References Cited

U.S. PATENT DOCUMENTS

| | | | | |
|---|---|---|---|---|
| 6,220,898 | B1 * | 4/2001 | Wu | H01R 24/58 439/188 |
| 6,224,408 | B1 | 5/2001 | Wu | |
| 6,368,156 | B1 | 4/2002 | Lin | |
| 6,478,629 | B1 * | 11/2002 | Li | H01R 24/58 439/668 |
| 6,575,793 | B1 | 6/2003 | Li et al. | |
| 6,923,687 | B2 | 8/2005 | Wang | |
| 7,361,062 | B2 * | 4/2008 | Long | H01R 24/58 439/668 |
| 7,527,525 | B2 | 5/2009 | Long et al. | |
| 7,591,685 | B2 * | 9/2009 | Zhu | H01R 12/57 439/668 |
| 8,287,314 | B1 | 10/2012 | Gao et al. | |
| 8,951,071 | B2 * | 2/2015 | Tziviskos | H01R 13/15 439/668 |
| 2008/0057791 | A1 | 3/2008 | Long et al. | |
| 2008/0299837 | A1 | 12/2008 | Long et al. | |

* cited by examiner

CONTACT-SUPPORT MECHANISM FOR INCREASED RETENTION FORCE

CROSS-REFERENCES TO RELATED APPLICATIONS

This application is a continuation of U.S. patent application Ser. No. 13/913,277, filed Jun. 7, 2013, which is a non-provisional of U.S. provisional patent application No. 61/799,119, filed Mar. 15, 2013, which are incorporated by reference.

BACKGROUND

Portable electronic devices, such as portable media players, tablet, netbook, and laptop computers, cell, media, and smart phones, have become ubiquitous in recent years. These devices often include an audio jack through which they receive and provide audio information. The audio jacks may include, or be connected to, electronic circuits such as audio drivers for driving headphones or speakers, audio receivers for receiving audio signals from a microphone, and other circuits. These audio jacks may be arranged to receive an audio plug that may be connected to headphones, speakers, microphones, or other equipment.

These audio plugs may be electrical audio plugs. Audio jacks may include a number of ring-shaped contacts along their lengths. These contacts may connect to conductors in a cable attached to the audio plug. These contacts may include contacts for left audio, right audio, ground, and microphone. These audio plugs may also be optical audio plugs, that is, they may have an opening at an end to transmit or receive optical signals. In such a situation, the audio plug may be formed of plastic or other nonconductive material.

When an audio plug is inserted into an audio jack, it may be desirable that the audio plug remain in a fixed position. Since the audio plug may be connected to headphones or ear buds through a cord, forces may be exerted on the plug in a direction that could inadvertently remove the audio plug from the audio jack.

Also, some electronic devices employing audio jacks may achieve great commercial success. As such, millions of these audio jacks may need to be manufactured. Due to the magnitude of this task, any simplification in the assembly process is multiplied the millions of times the audio jacks are assembled. Accordingly, it may be desirable to provide an audio jack that is readily manufactured.

Thus, what is needed are circuits, methods, and apparatus that may provide audio jacks capable of providing a sufficient retention force to avoid at least some inadvertent extractions of an audio plug. It may also be desirable that these audio jacks be readily assembled.

SUMMARY

Accordingly, embodiments of the present invention provide circuits, methods, and apparatus that may provide audio jacks capable of providing a sufficient retention force to avoid at least some inadvertent extractions of an audio plug. Some of these embodiments may also provide audio jacks that may be readily assembled. While embodiments of the present invention are well-suited to audio jacks, other types of connectors may be realized consistent with embodiments of the present invention.

An illustrative embodiment of the present invention may provide contact structures having one or more contacts, each having a contact support mechanism to increase contact retention force. In various embodiments of the present invention, different materials may be used to form the contacts than what is used to form the contact support mechanisms. In this way, contacts may be formed using a highly conductive material, while the support mechanism may be formed of a material having good spring characteristics. While a contact formed of a highly conductive material may not be able to provide an adequate retention force on its own, the use of a contact support mechanism having good spring characteristics may sufficiently increase the retention force to prevent accidental extractions of an audio plug or other connector.

Again, the contacts may be formed of a material having a low series resistance or impedance. For example, the contacts may be formed using titanium copper, copper, bronze, phosphor bronze or other bronze alloy, or other material. This material may be highly conductive to reduce contact resistance and reduce signal loss through the contact.

The contact supports may be formed using a material having good spring characteristics. For example, the contact supports may be formed using stainless steel, such as stainless steel 301, beryllium copper, spring steel, or other such material. The contact supports may be alternatively formed using a compressible material. For example, the compressible material may be rubber, foam, or other such material. These materials may increase the retention force generated by a contact and corresponding contact support such that accidental extractions of a connector plug or other contact are reduced. Also, while one contact support mechanism may be used for each contact, in other embodiments of the present invention, more than one contact support mechanism may be used to increase the retention force of a contact. In still other embodiments, one contact support may be used for more than one contact. The contacts and contact supports may be formed using stamping, machining, metal-injection molding, 3-D printing, or other manufacturing process.

An illustrative embedment of the present invention may provide a method whereby audio jacks may readily be assembled. In a specific embodiment of the present invention, a first retention contact may be inserted in an audio jack housing. A first contact support may be inserted behind the first retention contact such that the first retention contact is between the first contact support and a passage in the housing for an audio plug. A plug may be inserted into the passage in the housing. The plug may contact the first retention contact at a first contact portion.

The first retention contact may deflect due to this contact. A switch contact may then be inserted. Since the first retention contact is deflected at this point, the switch contact may be readily inserted. The plug may then be withdrawn, and the first retention contact may move towards it original position. A first contact portion of the switch may contact a second contact portion of the first retention contact as the retention contact returns to its original position.

In this and various embodiments of the present invention, more than one retention contact and corresponding contact support and switch contacts may be included and inserted into the housing. For example, two retention contacts may be included. These retention contacts may be used as audio contacts, such as left audio contacts. Additional contacts for audio, microphone, and ground (or grounds) may be included and inserted into the housing either before or after the retention contacts and corresponding contact supports and switch contacts are inserted. An optical light-emitting diode module may be included at a rear of the housing passage.

While embodiments of the present invention are well-suited to audio jacks having right and left audio, ground, and microphone contacts, embodiments of the present invention may be employed in other types of audio jacks and other types of connectors. For example, embodiments of the present invention may provide audio jacks having right and left audio contacts and one or more ground contacts. In other embodiments of the present invention, one or more contacts may be used for other digital or audio signals, or the one or more contacts may be used for more than one type of signal depending on a configuration of circuitry associated with the audio jack.

Still other embodiments of the present invention may be used in other types of connectors. An embodiment of the present invention may provide a first connector having a contact structure. The contact structure may include a first contact having a first contact portion to deflect when the first contact is mated with a corresponding contact in a second connector. The first contact may provide a retention force at the first contact portion, where the retention force maintains a position of the second connector when the second connector is mated with the first connector. The contact structure may include a first contact support located such that at least a portion of the first contact is between the first contact support and the corresponding contact in the second connector. The first contact support may increase the retention force provided at the first contact portion of the first contact.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
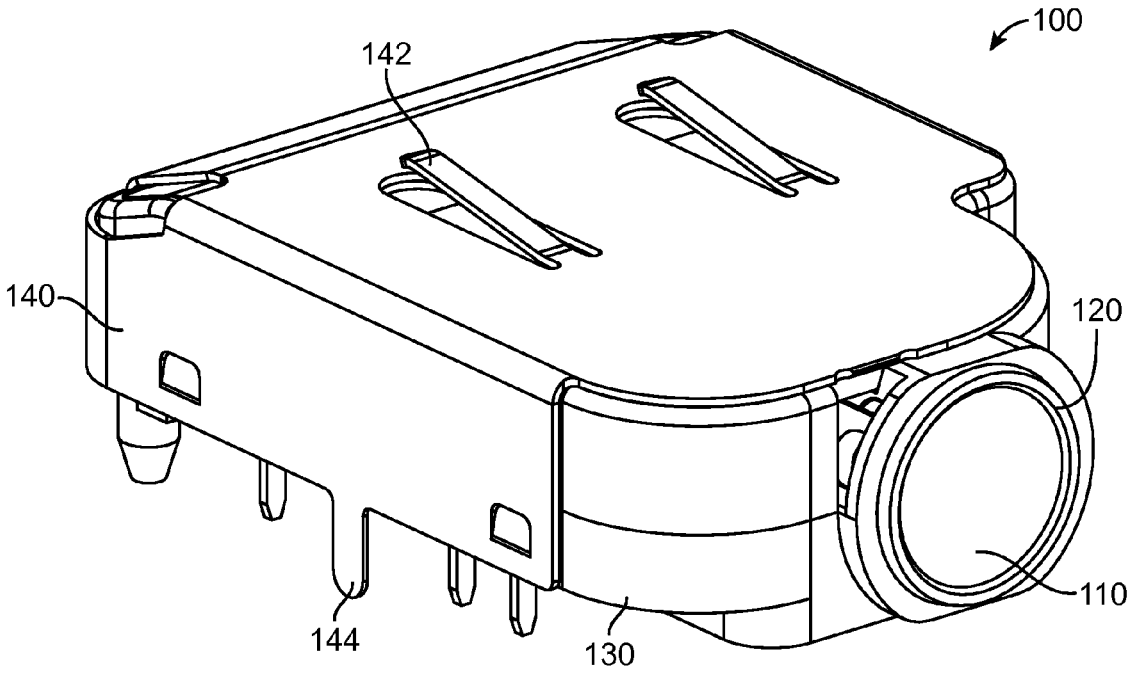
FIG. 1 illustrates an audio jack consistent with an embodiment of the present invention.

FIG. 1 illustrates an audio jack consistent with an embodiment of the present invention. This figure, as with the other included figures, is shown for illustrative purposes and does not limit either the possible embodiments of the present invention or the claims.

Audio jack 100 may include housing 130 covered by shell or shield 140. Housing 130 may include passage 120 forming an opening 110. Opening 110 in passage 120 may accept an audio plug (not shown.) Shell 140 may include one or more fingers 142. Fingers 142 may form electrical connections with a device enclosure or other structure. Shell 140 may further include tabs 144. Tabs 144 may be inserted into openings in a main-logic board or other appropriate substrate. Tabs 144 may further be soldered to form a connection to a ground plane or trace on the board.

Figure 2:
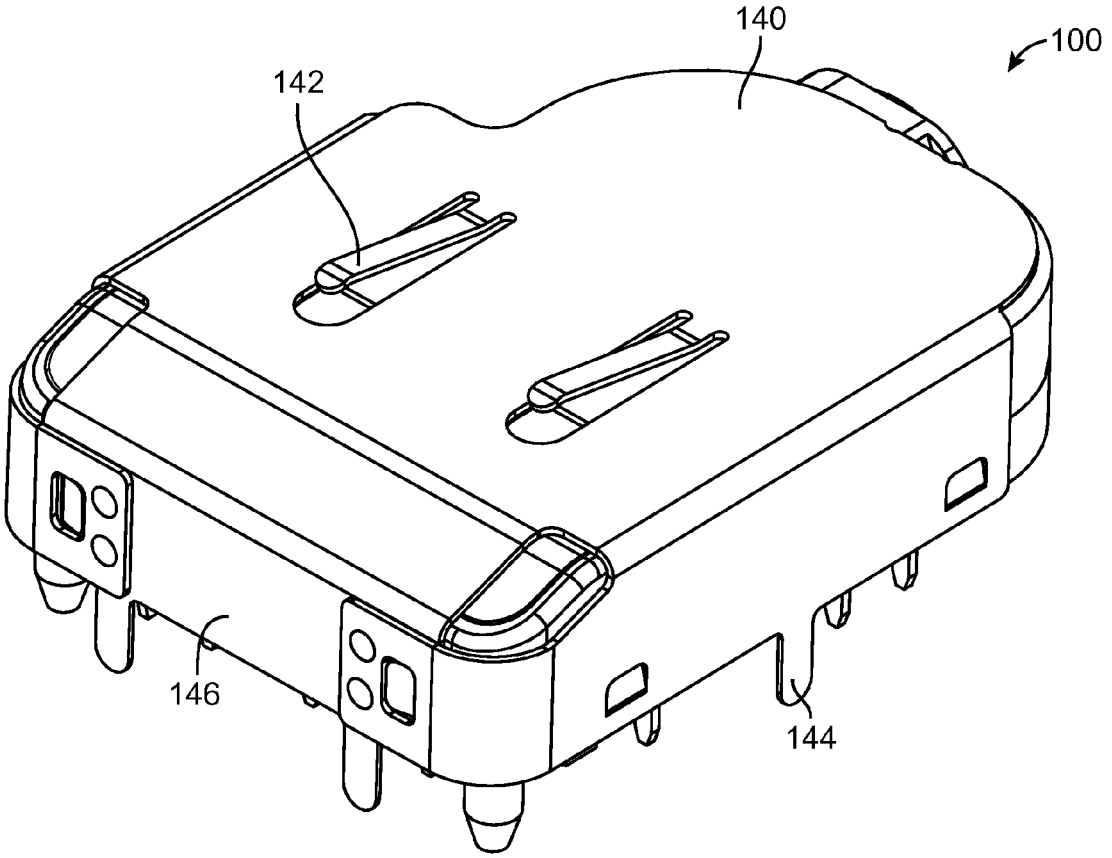
FIG. 2 illustrates a rearview of an audio jack consistent with an embodiment of the present invention.

FIG. 2 illustrates a rearview of an audio jack consistent with an embodiment of the present invention. Audio jack 100 may include shell 140, which may include fingers 142 and tabs 144. Shell 140 may further include a back side 146.

Figure 3:
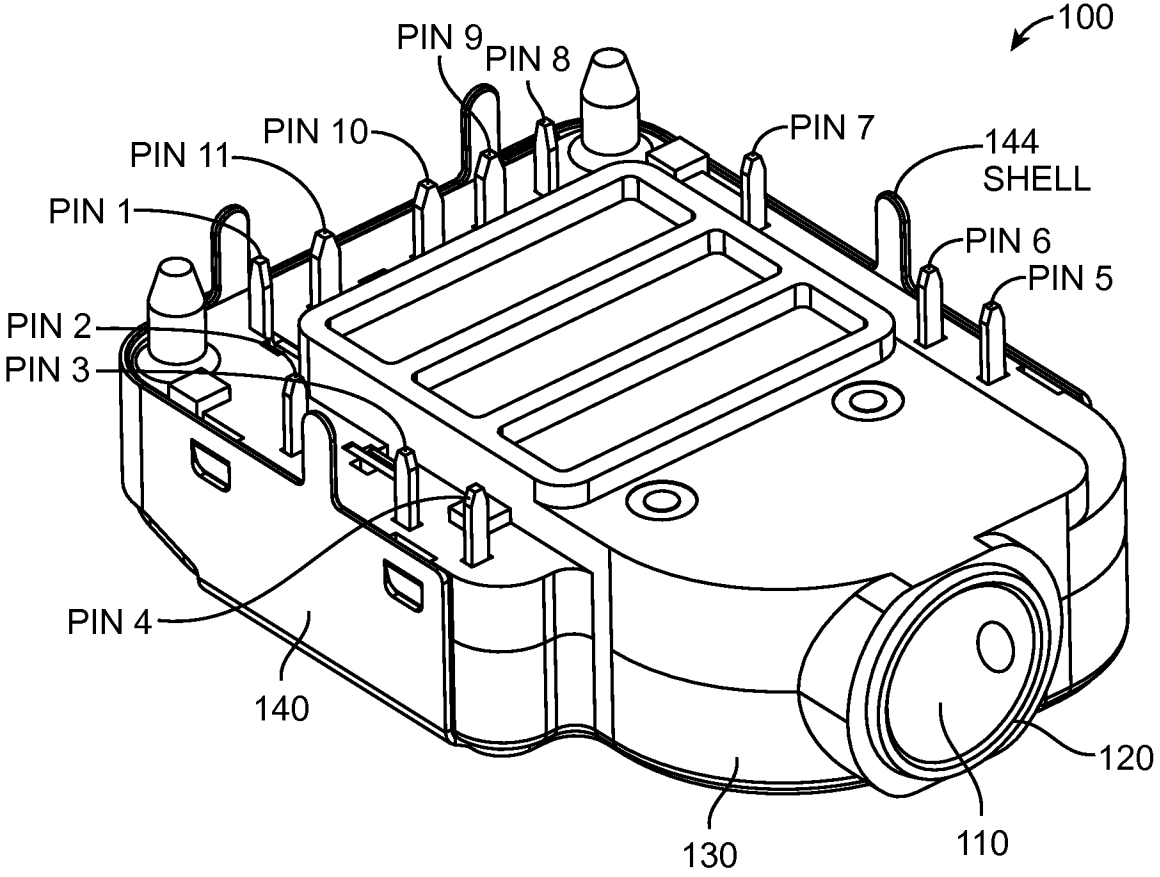
FIG. 3 illustrates an underside view of an audio jack consistent with an embodiment of the present invention.

FIG. 3 illustrates an underside view of an audio jack consistent with an embodiment of the present invention. Again, audio jack 100 may include housing 130, which may be at least partially covered by shell or shield 140. Housing 130 may include passage 120 forming opening 110. In this particular example, 11 pins may be brought out for connection to traces or planes on a main logic board. These pins may have the following functionality. Pins 1 and 8 may be insertion-detect pins, pins 2 and 7 may be audio and insert detect pins, pin 3 may be an audio pin, pins 4 and 6 may be ground, pin 5 may be a microphone pin, while pins 9-11 may be pins for an optical module, though in other embodiments of the present invention, other pins may be used and they may have different designations.

Again, an audio plug may be inserted into opening 110 in housing 130 of audio jack 100. This plug may be connected through a cable to ear buds, headphones, or other electronic structure. In such a configuration, a force may be applied to the audio plug through the cable. This force may, on occasion, inadvertently cause an extraction of the audio plug. Accordingly, embodiments the present invention provide retention contacts inside audio jack 100 that may be adequate to avoid at least some of these inadvertent extractions.

Again, embodiments of the present invention may provide a contact structure having a retention contact and a contact support. The contacts may be arranged to provide a good electronic connection, while the contact support may be arranged to reinforce the contact such that it provides an adequate retention force. An example illustrating various contacts in a specific embodiment of the present invention is shown in the following figure.

Figure 4:
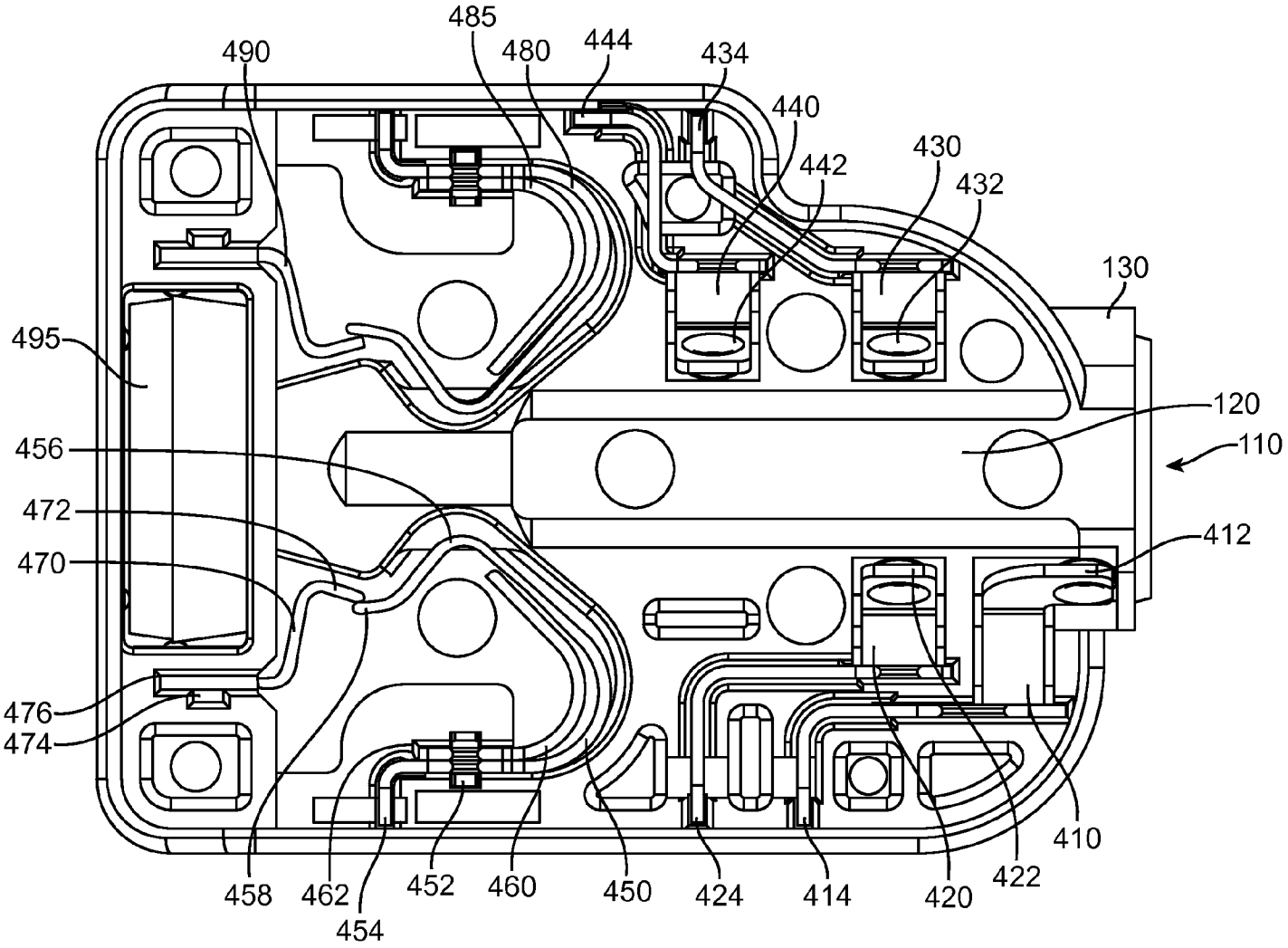
FIG. 4 illustrates a top view of a portion of an audio jack according to an embodiment of the present invention.

FIG. 4 illustrates a top view of a portion of an audio jack according to an embodiment of the present invention. In this example, a top cover and shell of the audio jack has been removed thereby exposing the inner contacts.

In this example, retention contacts 450 and 480 are provided. Contact support structures 460 and 485 may be located behind the retention contacts 450 and 480, such that retention contacts 450 and 485 are at least partially between contact support 460 and 465 and passage 120.

Again, by separating the functions of electrical connection and providing retention force, the materials used for contacts 450 and 480 and contact supports 460 and 485 may be chosen independently. Again, the material chosen for contacts 450 and 480 may be highly conductive in order to reduce impedance through the contacts. However highly conductive materials are often too soft and pliable to provide much retention force. Further, they may permanently set in a deflected position after several insertions of an audio plug. Accordingly, contact supports 460 and 485 may be formed using a material with good spring characteristics.

In various embodiments of the present invention, contacts 450 and 480 may be formed using titanium copper, bronze, and other materials. In these and other embodiments of the present invention, support contacts 460 and 485 may be formed using stainless steel, such as stainless steel 301, beryllium copper, spring steel, or other such material. The contact supports may be alternatively formed using a compressible material. For example, the compressible material may be rubber, foam, or other such material.

Contact 450 may include notch 452, which may be used to secure contact 450 in housing 130. Contact 450 may further include a contacting portion 454 exiting a bottom of the housing as pin 2 where it can be soldered to a main logic board or other appropriate substrate.

Contact 450 may further include a first contact portion 456. Contact portion 456 may engage an audio plug when it is inserted into passage 120 in housing 130. This engagement may cause contact 450 to deflect downward. Contact 450 may further include a second contacting portion 485, which may engage contacting portion 472 of switch contact 470. Switch contact 470 may include notch 474 which may be used to secure switch contact 470 in housing 130. Switch contact 470 may further include contact portion 476 which may exit through a bottom of housing 130 as pin 1, where it may be connected to a trace on a main logic board or other appropriate substrate. This audio jack may further include contact 480, contact support 485, and contacts switch 490 which may be similarly arranged.

In a specific embodiment of the present invention, contacts 450 and 480 may be used as audio contacts. In this specific example, other audio, ground, and microphone contacts may be included. For example, microphone contact 410 may include a contacting portion 412 and a through-hole contact portion 414, which may exit through a bottom of housing 132 as pin 5 to be connected to a trace on a printed circuit board or other appropriate substrate. Similarly, ground contacts 420 and 430 may include contacting portions 422 and 432, and contact tail portions 424 and 434, which are pins 6 and 4. By using multiple grounds, associated circuitry may detect a short between these contacts to determine that a metal audio plug is inserted into passage 120.

When a non-metallic audio plug is detected, the ground pins are not shorted, and LED module 495 and associated circuitry (not shown) may be activated. This audio jack may further include another audio contact 442, which may include contacting portions 442 and through-hole contact portion 444, which may be pin 3.

Figure 5:
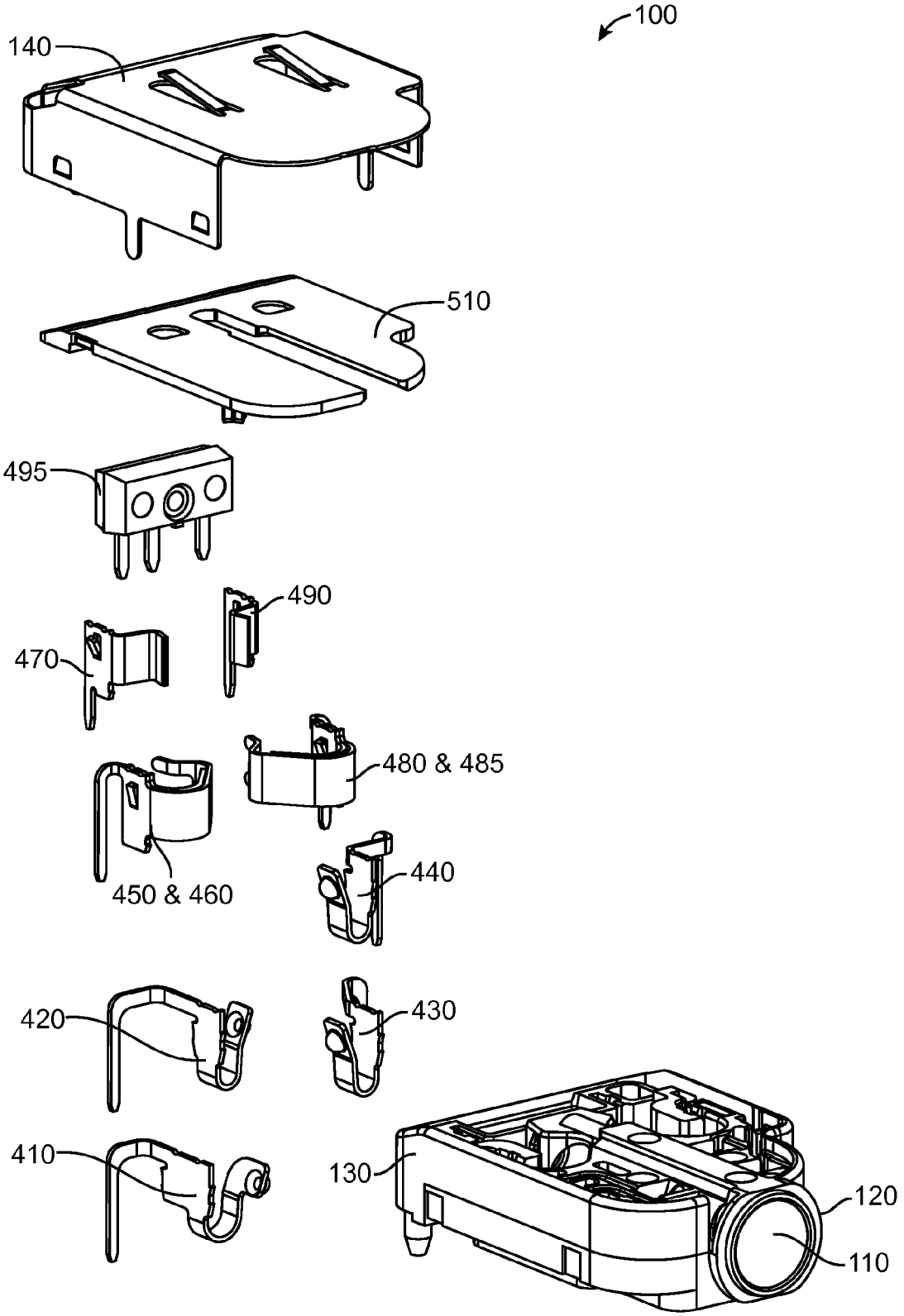
FIG. 5 illustrates components of an audio jack connector according to an embodiment of the present invention.

FIG. 5 illustrates components of an audio jack connector according to an embodiment of the present invention. Again, audio jack 100 may include housing 130 having a passage 120 forming opening 110. Microphone contact 410 may be included. One or more ground contacts, for example contacts 420 and 430 may be included. A first audio contact, which may be right audio contact 440, may be included. Retention contacts 450 and 480 and their contact supports 460 and 485 may also be included. Switch contacts 470 and 490, as well as optical or LED module 495 may also be inserted into housing 130. Insulative cover 510 may be placed over the top of housing 130. Shell or shield 140 may at least partially cover housing 130 and cover 510.

Figure 6:
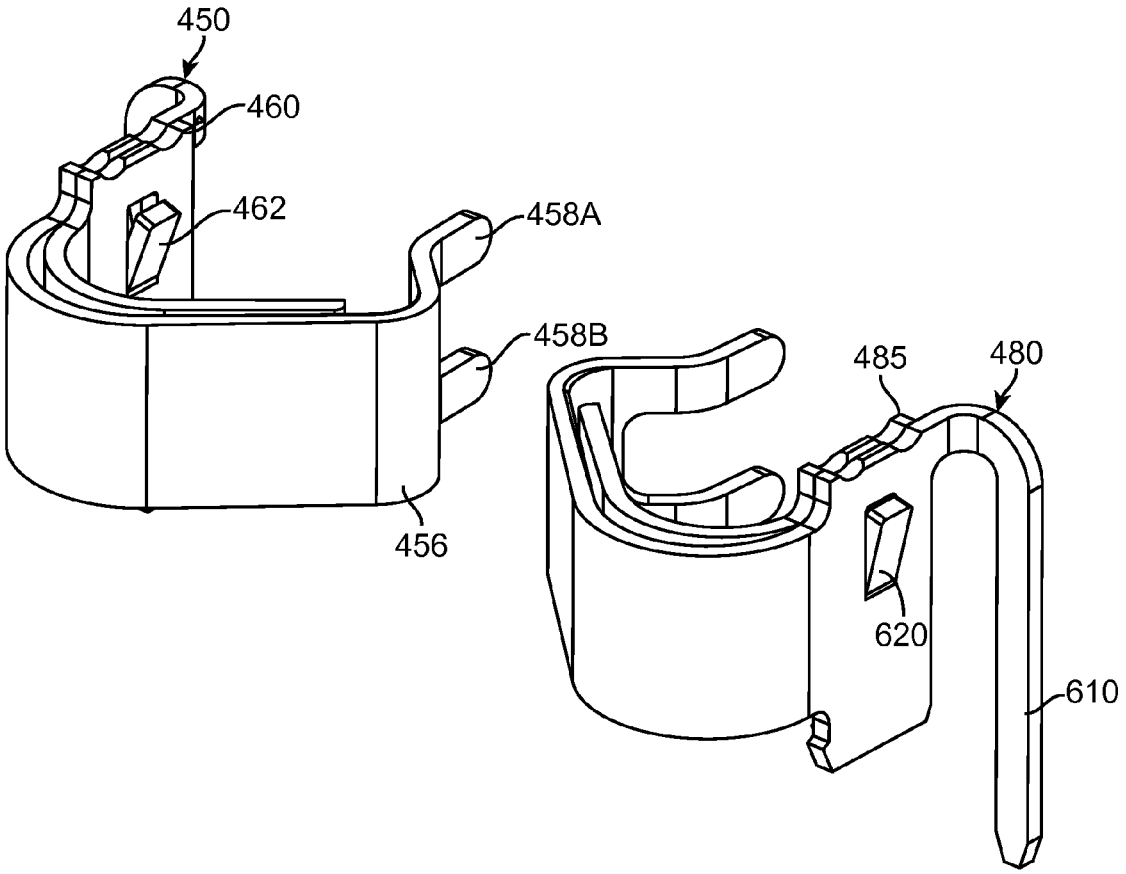
FIG. 6 illustrates a close-up view of contacts and contact supports according to an embodiment of the present invention.

FIG. 6 illustrates a close-up view of contacts and contact supports according to an embodiment of the present invention. Specifically, contacts 450 and 480 are shown as are contact supports 460 and 485. Each of these may include tabs, such as tabs 620 and 462, which may be used to help keep these contacts and contact supports in a fixed position in housing 130. These contacts may further include through-hole portions, such as through a portion 610, which may emerge from a bottom of housing 130 where they may be electrically connected to traces or planes on a main logic board or other appropriate substrate. Contacts 450 may include multiple contacting portions to contact switch contacts 470 and 490. Specifically, contact 480 may include one or more arms 458 to form electrical connections with switch contact 470. By including multiple arms, when a piece of debris forces one arm 458 to be electrically isolated, a second arm 458 may still function correctly.

Returning to FIG. 4, it can be seen that when an audio plug is not inserted into passage 120, second contact portion 458 of contact 450 remains electrically in contact with contacting portion 472 of switch contact 470. To maintain this electrical connection, it may be desirable to pre-bias contact 450 such that it applies a force against switch contact 470. However this force may make it difficult to correctly assemble this audio jack. Accordingly, embodiments of the present invention may provide a method for readily assembling this audio jack. One such method is outlined in the following figures.

Figure 7:
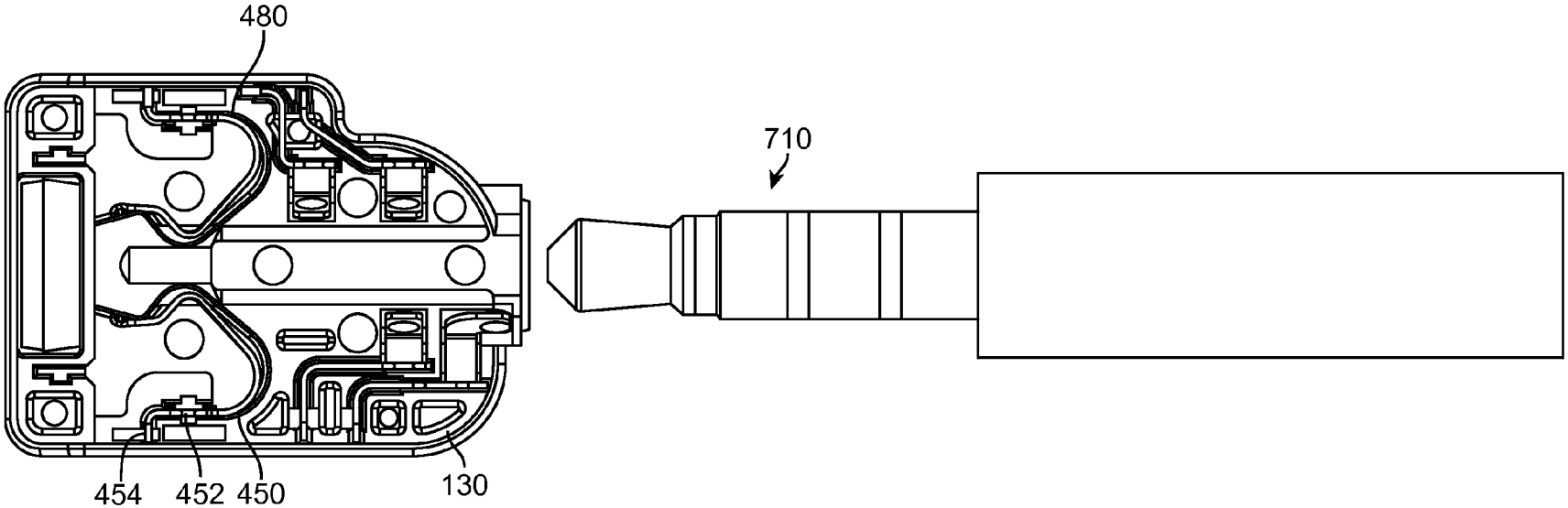
FIGS. 7-10 illustrate a method of assembling an audio jack according to an embodiment of the present invention.

In FIG. 7, contacts 450 and 480 may be inserted into housing 130. Specifically, tab 452 may be located in a corresponding tab in housing 130 such that contact 450 is secured in place. Through-hole contacting portion 454 may feed through an opening in housing 130, where it may emerge from a bottom of housing 130.

Figure 8:
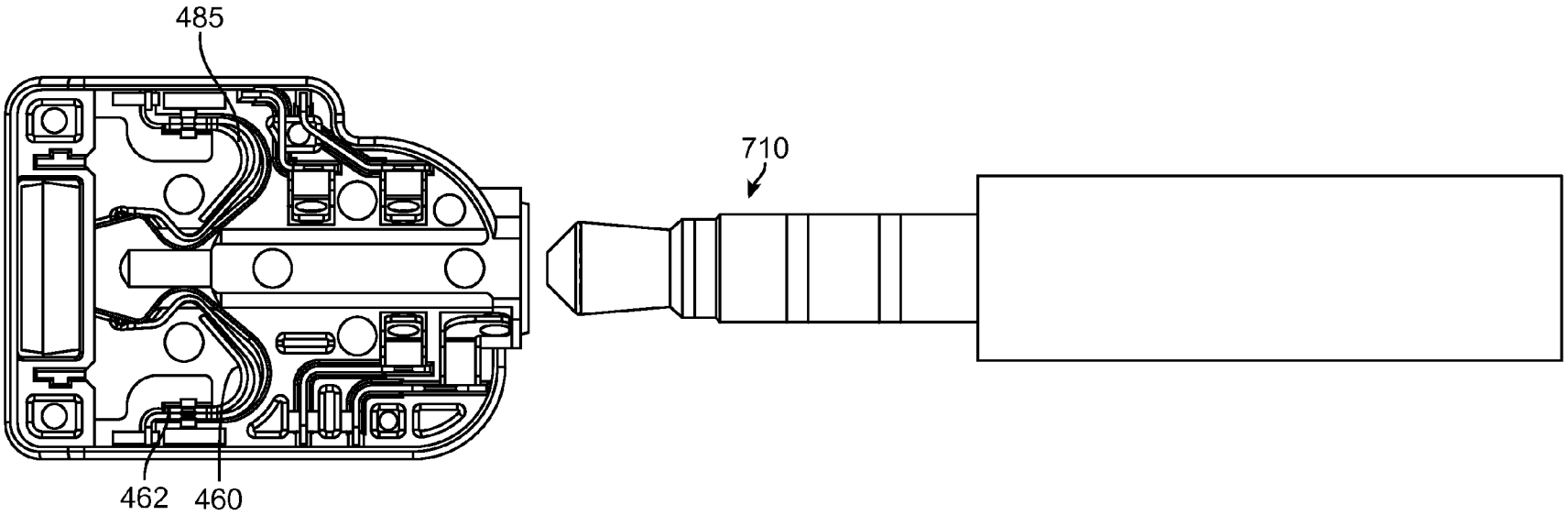

In FIG. 8, contact supports 460 and 485 may be inserted. Specifically, tab 462 may be fit into a corresponding notch in housing 130. In this way, notches 462 and 452 may fit in corresponding notches in housing 130 to help secure contacts 450 and contacts support 4 60 in place.

Figure 9:
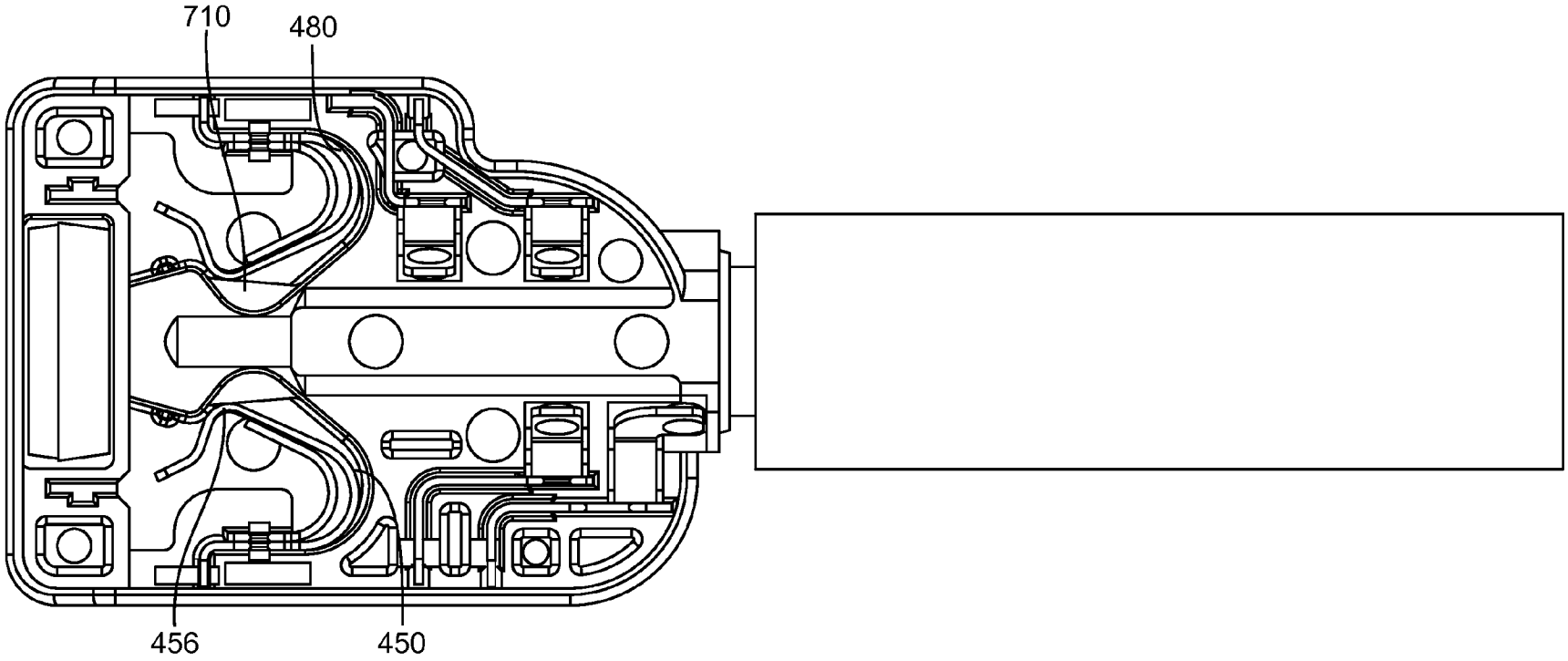

In FIG. 9, audio plug 710 may be inserted into passage 120 in housing 130. Plug 710 may engage contacts 450 and 480, for example at first contacting portion 456, and deflect these contacts.

Figure 10:
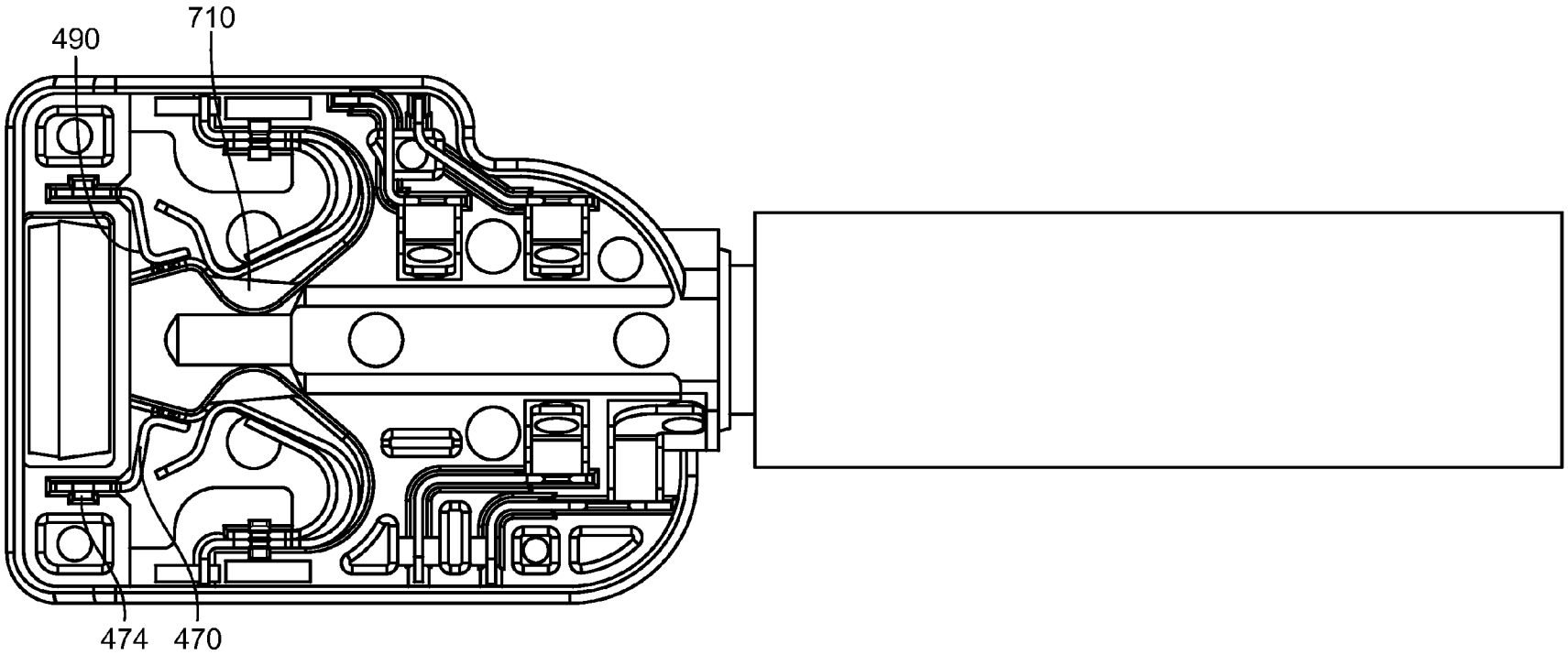

In FIG. 10, the deflection of contacts 450 and 480 allows switch contacts 470 and 490 to be inserted without interference from the retention contacts 450 and 480. Specifically, through-hole portion 476 may be inserted into an opening in housing 130 where it emerge through a bottom of housing 130 to be connected to a trace on a printed circuit board. Notch 474 may be fit into a corresponding notch in housing 130 to secure switch contact 470 in place.

Once switch contacts 470 and 490 are in place, audio plug 710 may be removed. At some point in, before, or after, this process, the remaining contacts and LED module may also be inserted.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A first connector comprising:

a first contact having a first contact portion to mate with a corresponding contact of a second connector when the second connector is mated with the first connector, and a second contact portion to be attached to a circuit board; and a first contact support located such that at least a portion of the first contact is in physical contact with the first contact support and between the first contact support and the corresponding contact in the second connector, wherein the first contact and the first contact support are made of different materials, wherein the first contact has a first side including a surface of the first contact portion to mate with a corresponding contact of a second connector, and a first length extending from the first contact portion to the second contact portion, and wherein the first contact support extends along a second side of the first contact for a majority of the first length, the second side opposite the first side.

2. The first connector of claim 1 wherein the first contact is formed using titanium copper.

3. The first connector of claim 2 wherein the first contact support is formed using stainless steel.

4. The first connector of claim 1 wherein the first contact support is formed using a compressible material.

5. The first connector of claim 4 wherein the compressible material is foam.

6. The first connector of claim 4 wherein the compressible material is rubber.

7. The first connector of claim 1 wherein the second contact portion of the first contact is a though-hole contact portion.

8. The first connector of claim 1 wherein the first contact provides a retention force against the corresponding contact of the second connector when the second connector is mated with the first connector and the retention force is increased by the first contact support.

9. The first connector of claim 1 wherein the first contact and the first contact support are formed separately.

10. The first connector of claim 1 wherein the first contact comprises the first contact portion to mate with a corresponding contact of a second connector, the second contact portion to be attached to a circuit board, and a first tab inserted in a housing of the first connector, wherein the second contact portion is to be attached directly to the circuit board, and wherein the first contact support comprises a second tab inserted in a housing of the first connector.

11. The first connector of claim 1 wherein the first contact comprises the first contact portion to mate with a corresponding contact of a second connector, the second contact portion to be attached to a circuit board, a tab inserted in a housing of the first connector, and a third contact portion and a fourth contact portion to contact a switch contact, wherein the second contact portion is to be attached directly to the circuit board.

12. A first connector comprising:

a first contact having a first contact portion to form an electrical connection with a corresponding contact of a second connector when the second connector is mated with the first connector; and a first contact support formed separately from the first contact and located such that at least a portion of the first contact is in physical contact with the first contact support, where the first contact provides a force against the corresponding contact of the second connector when the second connector is mated with the first connector and the force is increased by the first contact support, wherein the first contact has a first side including a surface of the first contact portion to mate with a corresponding contact of a second connector, a second contact portion to be directly attached to a printed circuit board, and a first length extending from the first contact portion to the second contact portion, and wherein the first contact support extends along a second side of the first contact for a majority of the first length, the second side opposite the first side.

13. The first connector of claim 12 wherein the first contact provides a retention force against the corresponding contact of a second connector when the second connector is mated with the first connector.

14. The first connector of claim 12 wherein the first contact further comprises a second contact portion, where the second contact portion is a though-hole contact portion.

15. The first connector of claim 12 wherein the first contact and the first contact support are made of different materials.

16. The first connector of claim 15 wherein the first contact is formed using titanium copper.

17. The first connector of claim 16 wherein the first contact support is formed using stainless steel.

18. The first connector of claim 12 wherein the first contact support is formed using a compressible material.

19. The first connector of claim 18 wherein the compressible material is foam.

20. The first connector of claim 12 wherein the first contact comprises the first contact portion to mate with a corresponding contact of a second connector, the second contact portion to be directly attached to a circuit board, and a first tab inserted in a housing of the first connector, wherein the first contact support further comprises a second tab inserted into the housing of the first connector.

21. A first connector comprising:

a first contact having a first contact portion to form an electrical connection with a second contact of a second connector when the second connector is mated with the first connector;

a first contact support formed separately from the first contact and located such that at least a portion of the first contact is in physical contact with the first contact support;

a third contact having a first contact portion to form an electrical connection with the second contact of the second connector when the second connector is mated with the first connector; and a second contact support located such that at least a portion of the third contact is in physical contact with the second contact support, wherein the first contact comprises the first contact portion to mate with a corresponding contact of a second connector, a second contact portion to be directly attached to a circuit board, and a first tab inserted in a housing of the first connector.

22. The first connector of claim 21 wherein the first contact provides a first force against the second contact of the second connector when the second connector is mated with the first connector and the first force is increased by the first contact support, and the third contact provides a second force against the second contact of the second connector when the second connector is mated with the first connector and the second force is increased by the second contact support.

23. The first connector of claim 22 wherein the first contact and the first contact support are made of different materials.

24. The first connector of claim 21 wherein the third contact and the second contact support are formed separately.

25. The first connector of claim 21 wherein the first contact has a first side including a surface of the first contact portion to mate with a corresponding contact of a second connector, the second contact portion to be directly attached to a printed circuit board, and a first length extending from the first contact portion to the second contact portion, wherein the first contact support extends along a second side of the first contact for a majority of the first length, the second side opposite the first side, and wherein the first contact support comprises a tab inserted in a housing of the first connector.

* * * * *